US006189825B1

(12) United States Patent
Mathieu et al.

(10) Patent No.: US 6,189,825 B1
(45) Date of Patent: Feb. 20, 2001

(54) METHOD FOR CONTROLLING THE WINDING DENSITY OF FILM ROLLS

(75) Inventors: Dieter Mathieu, Neunkirchen/Saar; Robert Schmidt, Homburg/Saar, both of (DE)

(73) Assignee: Hoechst Trespaphan GmbH, Wiesbaden (DE)

( * ) Notice: Under 35 U.S.C. 154(b), the term of this patent shall be extended for 0 days.

(21) Appl. No.: 09/302,453

(22) Filed: Apr. 30, 1999

(30) Foreign Application Priority Data

Apr. 30, 1998 (DE) ..... 198 19 276

(51) Int. Cl.[7] ..... B65H 23/18

(52) U.S. Cl. ..... 242/413.5; 242/541.6; 242/547

(58) Field of Search ..... 242/413.1, 413.2, 242/413.5, 547, 541.1, 541.4, 541.5, 541.6, 541.7

(56) References Cited

U.S. PATENT DOCUMENTS

| | | | | |
|---|---|---|---|---|
| 4,150,797 | * | 4/1979 | Kataoka | 242/541.6 |
| 4,238,084 | | 12/1980 | Kataoka . | |
| 4,508,284 | * | 4/1985 | Kataoka | 242/413.2 |
| 4,576,344 | | 3/1986 | Sasaki et al. . | |
| 5,039,023 | * | 8/1991 | Hagens et al. | 242/547 |
| 5,437,417 | * | 8/1995 | Kammann | 242/541.1 |

FOREIGN PATENT DOCUMENTS

| | | |
|---|---|---|
| 3602745 A1 | 8/1987 | (DE) . |
| 19604652 | 8/1997 | (DE) . |
| 0 393 519 B1 | 5/1994 | (EP) . |

* cited by examiner

*Primary Examiner*—Donald P. Walsh
*Assistant Examiner*—William A. Rivera
(74) *Attorney, Agent, or Firm*—Shanks & Herbert

(57) ABSTRACT

In a method and apparatus for controlling the winding density of film rolls, a desired and an actual winding density of a film roll are determined and compared with one another. The quantity obtained from the comparison is multiplied by an adapting or damping factor α, and the control output resulting therefrom is adapted to the film contact pressure and the film pull. The values thus obtained are fed as manipulated variables to a contact pressure actuator and a pull actuator for the film.

20 Claims, 2 Drawing Sheets

METHOD FOR CONTROLLING THE WINDING DENSITY OF FILM ROLLS

BACKGROUND OF THE INVENTION

1. Field of the Invention

The invention relates to a method for controlling the winding density of film rolls.

The winding density of a film roll is of central importance in the process of producing films. When winding or taking-up a film onto a reel or mandrel, a specific quantity of air is necessarily required between the individual layers. This air permits film shrinkage during storage of the film roll before processing and compensates for unevennesses in the profile. If a film web which inherently meets the specification is wound incorrectly, the result can be a total loss of the film roll owing to damage to the film web, in particular owing to storage. It is in this context that substantial quantities of air are also entrained with the film during winding of the film web. A portion of this entrained air escapes from the film roll during storage of the latter, and this can produce various defects in and on the film roll, such as sagging, stretching and transverse corrugations, which could cause the film to be ruined.

2. Description of the Related Art

In the device described in DE-C 32 65 570 (U.S. Pat. No. 4,576,344), a so-called pressure roller is used to press the film web running onto the reel against the film reel, the result being that air is entrained in smaller quantities than without this measure. The pressure exerted by the pressure roller can be controlled. With increasing winding speed, however, the air-displacing effect of the pressure roller decreases, and so it is necessary to compromise here between the winding speed and the entrainment of air.

European Patent 0 393 519 discloses a device for taking-up a film web onto a mandrel, including a pressure roller for feeding the film web to the film reel. In this case, the pressure roller and the film reel run at the same circumferential speed in opposite senses relative to one another. Two additional rollers are arranged axially parallel relative to the mandrel and to the pressure roller, and press the film web against the film roll and the pressure roller, respectively. In this case, the pressure roller has a smooth hard surface layer which has a mean roughness value $R_a<0.4\ \mu m$ and a Brinell hardness>10 HP 2.5/62.5. The roller bearing against the pressure roller is fixed during the winding operation and is pressed against the contact roller. It is connected to a cylinder at each end via an angle lever, and both cylinders are fastened on a pressure roller holder. The roller bearing against the film reel is movable mounted and guided by a cylinder which is pivotally mounted on the pressure roller holder. A spacer is mounted rotatably between the axes of the rollers and connects the two rollers to one another and keeps them at a distance from one another.

If the entrained quantity of air in a film roll is too low, shrinkage processes in conjunction with profile defects lead to stretching and thus damaging or ruining the film.

If the entrained quantity of air is too high, a multiplicity of other problems arise, such as displacement (i.e., lateral offset of the individual film layers) or central breakthroughs. Moreover, film rolls cannot be processed having an excessively high entrained quantity of air at high speeds, which generally leads to bottlenecks in processing capacity.

The winding density is to be understood as the ratio of the density of the taken-up plastic plus entrained air to the density of the pure plastic.

SUMMARY OF THE INVENTION

It is the object of the invention to create a method for controlling the winding density of film rolls, in which the winding density is as high as possible without resulting in stretching and thus limiting quality.

It is also an object of the invention to provide a device that can perform such a method.

These and other objects and advantages of the present invention are achieved by a method for controlling the winding density of film in a roll on a mandrel. The method comprises calculating a desired value of the winding density $Wd_{des}$ and an actual value of the winding density $Wd_{act}$ based on profile quality $R_w$, shrinkage S, air gap L, and mean thickness $\overline{D}$ for the film, outside diameter D of the film roll, and diameter d of the mandrel; comparing the desired and actual values of the winding density with one another in a controller; calculating an output value y to compensate for winding system deviation; and manipulating variable film pull and contact pressure in accordance with the output value y.

The above and other objects and advantages of the present invention are also achieved by a device for controlling the winding density of film in a roll on a mandrel. The device comprises a computer adapted for calculating a desired value of the winding density $Wd_{des}$ and an actual value of the winding density $Wd_{act}$ based on profile quality $R_w$, shrinkage S, air gap L, and mean thickness $\overline{D}$ for the film, outside diameter D of the film roll, and diameter d of the mandrel; a controller adapted for comparing the desired and actual values of the winding density with one another in a controller; a multiplier adapted for calculating an output value y to compensate for winding system deviation; and at least one actuator adapted for manipulating at least one of film pull and contact pressure in accordance with the output value y.

Further objects, features, and advantages of the invention will become apparent from the detailed description that follows.

BRIEF DESCRIPTION OF THE DRAWINGS

Examples of a method and a device according to the invention for controlling the winding density of film rolls on film reels are explained below in more detail with the aid of the drawings and a flowchart in which.

DETAILED DESCRIPTION OF THE PREFERRED EMBODIMENTS

Figure 1:
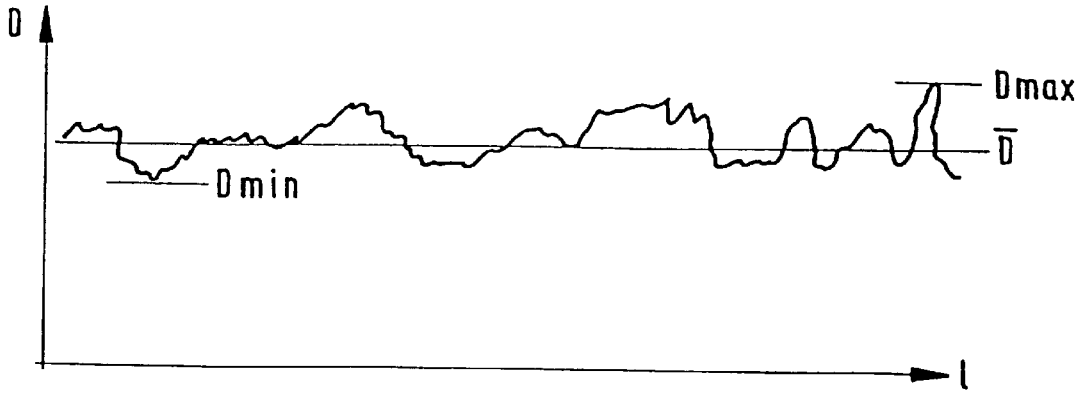
FIG. 1 shows a diagram of the variation in the thickness of a transverse thickness profile of a film.

According to the present invention, a desired value of the winding density is compared in a controller with an actual value of the winding density. The desired winding density, $Wd_{des}$, is calculated from the current profile quality measure $R_w$, the film length shrinkage S, the air gap L and the mean film thickness $\overline{D}$. The actual winding density, $Wd_{act}$, is calculated from the reel outside diameter D, mandrel diameter d, the run length l and the mean film thickness $\overline{D}$.

A calculated control output y compensates for system deviations via the manipulated variables of film pull and contact pressure.

The control output y is calculated by the controller and is multiplied by an adapting or fitting factor α, which is a function of run length and is less than 1 only in the vicinity of the mandrel diameter.

The control output $y_1=\alpha\cdot y$, thus corrected, is distributed between actuators for the film pull and for the contact pressure.

In an embodiment of the method, the desired value of the winding density $Wd_{des}$ is determined in accordance with the relationship $$Wd_{des} = \frac{1}{1 + R_w + S + \frac{L}{\overline{D}}}.$$

The profile quality $R_w$ and the mean film thickness $\overline{D}$ are determined by means of in-line measurement, and the longitudinal shrinkage S and the air gap L are prescribed.

The actual value of the winding density $Wd_{act}$ is determined in accordance with the relationship $$Wd_{act} = \frac{l\cdot\overline{D}}{(D^2 - d^2)\cdot\pi/4},$$

wherein l is the run length of the taken-up film, D is the corresponding outside diameter of film roll, and d is the mandrel diameter.

The measure for the profile quality $R_w$ is given by $$\frac{\overline{D}_{\max} - D_{\min}}{\overline{D}},$$

wherein $\overline{D}_{max}$ is the maximum thickness, $\overline{D}_{min}$ is the minimum thickness, and $\overline{D}$ is the mean thickness of the current transverse thickness profile of the film.

The shrinkage retardation behavior of the film, summarized in the term "change in length", and denoted as S, follows from $$S = \frac{\Delta l}{l_0}$$

wherein Δl is the change in length and $l_0$ is the initial length. The shrinkage retardation behavior takes into account the storage time, storage temperature, the longitudinal shrinkage and the web tension, which act on the film.

In the method according to the invention, the desired value of the winding density is no longer a constant for the individual type of film, as has so far been generally assumed in the prior art. Instead, the winding density is a function of the parameters of profile quality $R_w$, mean film thickness $\overline{D}$, the air gap L, and the shrinkage S.

In the present application, the terms "film" or "film web" are used to describe, any type of film or filmweb, such as a plastic film or web. The film can include or consist of any type of plastic, such as polyolefins, including polypropylene. The terms "film roll" or "roll of film" are used to describe film that is arranged to continuously overlay itself, and the terms "taking-up" or "winding" are used to describe the act of overlaying the film on itself. The terms "mandrel" or "reel" are used to describe a rotatable shaft upon which the film roll is wound.

In FIG. 1, the film thickness D is plotted against the length of the film web, as it is determined, for example, by means of conventional measuring methods which will not be gone into in more detail here. The film thickness D fluctuates about the mean film thickness $\overline{D}$ and exhibits a maximum film thickness $\overline{D}_{max}$ and a minimum film thickness $\overline{D}_{min}$. The profile quality $R_w$ of the film web is determined by these transverse profile measurements in accordance with the formula $$R_W = \frac{\overline{D}_{\max} - \overline{D}_{\min}}{D} = \frac{\Delta\overline{D}}{\overline{D}}.$$

As is known, this is not a pure measurement of transverse thickness, since the traversing measuring head moves transversely over the running film web. However, this has an insubstantial effect on the described method.

Figure 2:
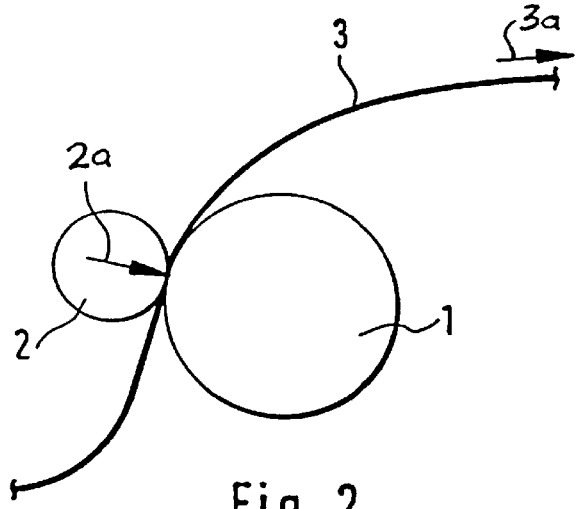
FIG. 2 shows a pressure roller pressing the film against a deflecting roller.
Figure 3:
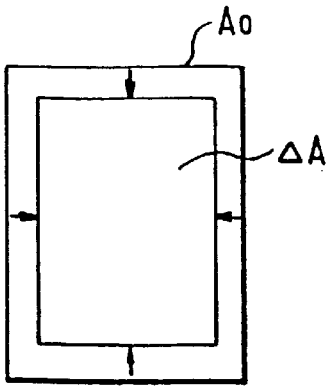
FIG. 3 shows a diagram of the longitudinal shrinkage of a film.

FIG. 2 shows a deflecting roller 1 and a pressure roller 2, with film 3 running between these two rollers 1 and 2. The pressure roller 2 exerts a contact pressure in the direction of the arrow 2*a* on the film 3. It is possible to vary this contact pressure via an actuator 8 (shown in FIG. 4). Moreover, a film pull is exerted on the film in the direction of the arrow 3*a*. The film pull is also variable via an actuator 7 (shown in FIG. 4).

Figure 4:
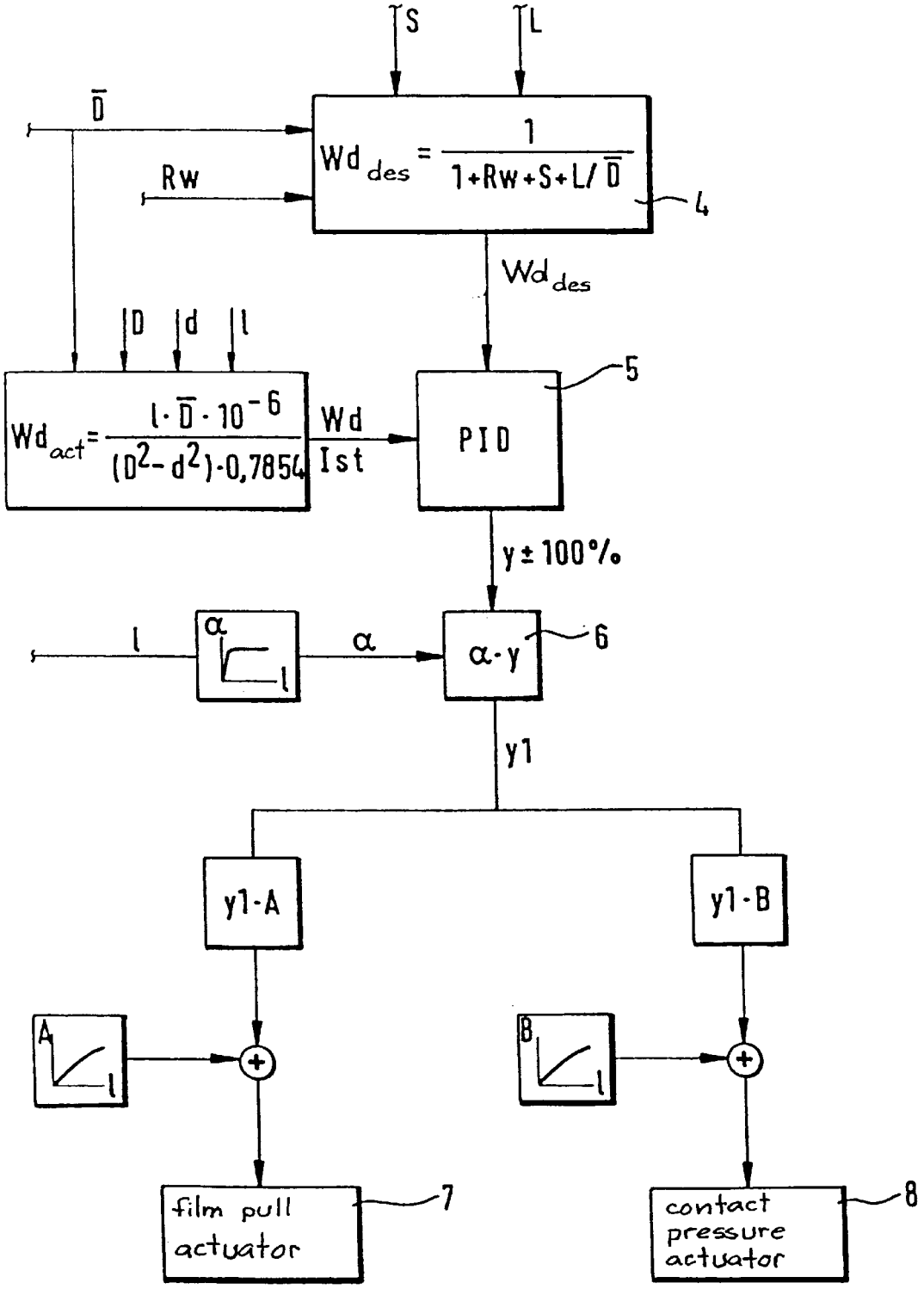
FIG. 4 shows a flowchart for the winding density of a film roll.

In the flowchart shown in FIG. 4, the parameters of profile quality $R_w$, shrinkage S, air gap L and mean thickness $\overline{D}$ of the film 3 are input into a computer 4. The prescribed value for the air gap L lies in the range from 0.1 to 5 μm and depends on the film type. For polypropylene, the air gap L generally lies in the range from 0.5 to 1 μm. L is determined, in particular, by the film roughness, which can be measured in a known way.

The mean thickness $\overline{D}$ of the film transverse profile and the profile quality $R_w$ are measured in a known way during film production. The longitudinal shrinkage is specific to the material and varies between 0.1 and 4% of the initial length $l_0$.

Starting from the general formula for winding density $$Wd = \frac{\sum \rho_i V_i}{\rho_{KS}\sum V_i} \tag{1}$$

wherein $\eta_i$ is the density for i=KS or L, with KS standing for plastic and L for air, and $V_i$ is the volume. It follows from (1) that $$Wd = \frac{\rho_{KS}V_{KS} + \rho_L V_L}{\rho_{KS}(V_{KS} + V_L)} \tag{2}$$

wherein the numerator specifies the quantity of plastic and air, and the denominator specifies the quantity of plastic in the volume of the plastic/air mixture. Since the air density $\eta_L \ll \eta_{KS}$ and the air volume $V_L < V_{KS}$, it follows that $\eta_{KS}\cdot V_{KS} \gg \eta_L\cdot V_L$. Thus, from (2) it follows that $$Wd = \frac{\rho_{KS}V_{KS} + \rho_L V_L}{\rho_{KS}(V_{KS} + V_L)} = \frac{1}{1 + \frac{V_L}{V_{KS}}}. \tag{3}$$

The air volume is given by $V_L = d_L\cdot L\cdot B$ and the plastic volume is given by $V_{KS} = d_{KS}\cdot L\cdot B$, wherein L is the length and B is the width of the film. The terms $d_L$ and $d_{KS}$ are the mean thickness of the entrained air and of the film, respectively. Thus, it follows from (3) that $$Wd = \frac{1}{1 + \frac{d_L}{d_{KS}}}. \quad (4)$$

The mean thickness $d_L$ of the air is defined as follows:

$$d_L = d_{L,min} + \Delta d_{L,S} + \Delta d_{L,R} \quad (5)$$

wherein the minimum thickness of the air &,min is defined by $L/\overline{D} = d_{L,min}/d_{KS}$. The shrinkage S is defined by $S = \Delta\delta_{L,S}/d_{KS}$, and the profile quality $R_w$ is defined by $R_w = \Delta\delta_{L,R}/d_{KS}$. Thus, it follows from equations (4) and (5) that $$Wd_{des} = \frac{1}{1 + R_W + S + \frac{L}{\overline{D}}} \quad (6)$$

It follows from equation (3) that the actual winding density $Wd_{act}$ is given by:

$$Wd_{act} = \frac{V_{KS}}{V_{KS} + V_L}. \quad (7)$$

With $$V_{KS} + V_L = \pi/4(D^2 - d^2) \cdot B \quad (8)$$

and $$V_{KS} = 1 \cdot \bar{D} \cdot B, \quad (9)$$

it follows that $$Wd_{act} = \frac{l \cdot \overline{D}}{\pi/4(D^2 - d^2)} = \frac{l \cdot \overline{D} \cdot 10^{-6}}{0.7854(D^2 - d^2)}. \quad (10)$$

when the mean film thickness $\overline{D}$ is measured in $\mu$m, and the remaining quantities are measured in meters.

In the computer 4 in the flowchart in accordance with FIG. 4, the desired winding density $Wd_{des}$ is continuously calculated from the parameters S, L, $\overline{D}$ and $R_w$ during the take-up operation using equation (6).

The calculation of the actual winding density $Wd_{act}$ is performed in accordance with equation (10). The values obtained for the actual winding density $Wd_{act}$ and the desired winding density $Wd_{des}$ are fed into a controller 5. The values $Wd_{des}$ and $Wd_{act}$ fed into the controller 5 are processed to form an output value y. The output value y is multiplied in the multiplier circuit 6 by a so-called adapting or fitting value $\alpha$ for the diameter of the film roll. The adapting value $\alpha$ is a function of the run length l of the film and serves the purpose of avoiding excessively large excursions of the control process in the vicinity of the mandrel diameter. Finally, the adapting value $\alpha$ constitutes a damping factor which rises steeply in the vicinity of the mandrel diameter and reaches saturation after a relatively short run length l. The product of the adapting value $\alpha$ and the output value y of the controller 5 yields a control output value $y_1$ which is multiplied by a first factor A and multiplied by a second factor B, wherein A+B=1. The factors A and B reproduce the adaptation to the film pull and the film contact pressure. The adapted control outputs $y_1 \cdot A$ and $y_1 \cdot B$ are adjusted using values of a given function for the film pull and the film contact pressure as a function of the run length l of the film. The adjustment determines the desired values for an actuator 7 for the film pull and an actuator 8 for the contact pressure actuator, and these desired values are fed into the actuators 7, 8.

For each film type, the winding density is a function of the profile quality, the mean thickness of the film, the shrinkage and the air gap, and is therefore not a constant. In the case of a poor profile quality, that is to say a relatively large $R_w$, it is necessary to wind more softly than in the case of a small $R_w$.

German Patent Application No. 198 19276.2, filed Apr. 30, 1998, is hereby incorporated in its entirety.

Although only a few exemplary embodiments of the present invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A method for controlling the winding density of film in a roll on a mandrel, comprising: calculating a desired value of the winding density $Wd_{des}$ and an actual value of the winding density $Wd_{act}$ based on profile quality $R_w$, shrinkage S, air gap L, and mean thickness $\overline{D}$ for the film, outside diameter D of the film roll, and diameter d of the mandrel; comparing the desired and actual values of the winding density with one another in a controller; calculating an output value y to compensate for winding system deviation; and manipulating variable film pull and contact pressure in accordance with the output value y.

2. The method as claimed in claim 1, in which the output value y of the controller is multiplied by an adapting factor $\alpha$ that is less than 1 only when the outside diameter D is in the vicinity of the mandrel diameter d.

3. The method as claimed in claim 2, wherein a control output $y_t = \alpha \cdot y$ of the multiplier circuit is multiplied by a first factor A and a second factor B such that A+B=1, and the factors A and B reproduce adaptation to the film pull and the film contact pressure, respectively.

4. The method as claimed in claim 3, wherein adapted control outputs $y_1A$ and $y_1B$ are compared with values of a given function for the film pull and the film contact pressure as a function of run length of the film, and corrected function values for the contact pressure and the film pull are supplied to respective actuators.

5. The method as claimed in claim 4, wherein the corrected function values for the film pull and the contact pressure are stored for initializing a subsequent winding operation.

6. The method as claimed in claim 2, wherein the shrinkage S is 0.1 to 4% relative to the non-shrunk film.

7. The method as claimed in claim 2, wherein the profile quality is $$R_W = \frac{D_{max} - D_{min}}{\overline{D}} = \frac{\Delta D}{\overline{D}},$$

wherein $D_{max}$ is the maximum thickness, $D_{min}$ is the minimum thickness and $\overline{D}$ is the mean thickness of a transverse thickness profile of the film.

8. The method as claimed in claim 1, wherein the desired value of the winding density $Wd_{des}$ is determined in accordance with the relationship $$Wd_{des} = \frac{1}{1 + R_W + S + \frac{L}{\overline{D}}},$$

wherein the shrinkage S and the air gap L are prescribed for the film, and the mean film thickness $\overline{D}$ and profile quality $R_w$ are detected by measurement.

9. The method as claimed in claim 8, wherein the actual value of the winding density W is determined in accordance with the relationship $$Wd_{act} = \frac{l \cdot \overline{D}}{(D^2 - d^2)\pi/4},$$

wherein l is the run length of the film taken-up on the mandrel.

10. The method as claimed in claim 1, wherein the air gap L is in the range from 0.5 to 5 $\mu$m.

11. The method as claimed in claim 10, wherein the air gap L is in the range from 0.5 to 1 $\mu$m.

12. A device for controlling the winding density of film in a roll on a mandrel, comprising:

a computer adapted for calculating a desired value of the winding density $Wd_{des}$ and an actual value of the winding density $Wd_{act}$ based on profile quality $R_w$, shrinkage S, air gap L, and mean thickness $\overline{D}$ for the film, outside diameter D of the film roll, and diameter d of the mandrel;

a controller adapted for comparing the desired and actual values of the winding density with one another in a controller;

a multiplier adapted for calculating an output value y to compensate for winding system deviation; and at least one actuator adapted for manipulating at least one of film pull and contact pressure in accordance with the output value y.

13. The device as claimed in claim 12, wherein said multiplier multiplies the output value y of the controller by an adapting factor $\alpha$ that is less than 1 only when the outside diameter D is in the vicinity of the mandrel diameter d.

14. The device as claimed in claim 13, wherein said multiplier multiplies a control output $y_i = \alpha \cdot y$ by a first factor A and a second factor B such that A+B=1, and the factors A and B reproduce adaptation to the film pull and the film contact pressure, respectively.

15. The device as claimed in claim 14, further comprising:

a first comparator comparing adapted control output $y_1A$ with a value of a given function for the film pull as a function of run length of the film, and supplying a corrected function value for the film pull to a first one of said at least one actuator; and a second comparator comparing adapted control output $y_1B$ with a value of a given function for the film contact pressure as a function of run length of the film, and supplying a corrected function value for the contact pressure to a second one of said at least one actuator.

16. The device as claimed in claim 12, wherein said computer calculates the desired value of the winding density $Wd_{des}$ in accordance with the relationship $$Wd_{des} = \frac{1}{1 + R_W + S + \frac{L}{\overline{D}}},$$

wherein the shrinkage S and the air gap L are prescribed for the film, and the mean film thickness $\overline{D}$ and profile quality $R_w$ are detected by measurement.

17. The device as claimed in claim 16, wherein said computer calculates the actual winding density $Wd_{act}$ in accordance with the relationship $$Wd_{act} = \frac{l \cdot \overline{D}}{(D^2 - d^2)\pi/4},$$

wherein l is the run length of the film taken-up on the mandrel.

18. The device as claimed in claim 12, wherein the air gap L is in the range from 0.5 to 5 $\mu$m.

19. The device as claimed in claim 18, wherein the air gap L is in the range from 0.5 to 1 $\mu$m.

20. The device as claimed in claim 12, wherein the shrinkage S is 0.1 to 4% relative to the non-shrunk film.

* * * * *